US008683660B2

(12) United States Patent
Hasegawa et al.

(10) Patent No.: US 8,683,660 B2
(45) Date of Patent: Apr. 1, 2014

(54) SNAP BUTTON

(75) Inventors: Kenji Hasegawa, Tokyo (JP); Kazuhiko Suzuki, Tokyo (JP); Hiroyuki Sugiyama, Tokyo (JP)

(73) Assignee: YKK Corporation (JP)

( * ) Notice: Subject to any disclaimer, the term of this patent is extended or adjusted under 35 U.S.C. 154(b) by 69 days.

(21) Appl. No.: 13/322,977

(22) PCT Filed: Jun. 10, 2009

(86) PCT No.: PCT/JP2009/060635
§ 371 (c)(1),
(2), (4) Date: Feb. 13, 2012

(87) PCT Pub. No.: WO2010/143287
PCT Pub. Date: Dec. 16, 2010

(65) Prior Publication Data
US 2012/0124791 A1 May 24, 2012

(51) Int. Cl.
*A44B 17/00* (2006.01)

(52) U.S. Cl.
USPC ..... 24/114.05; 24/114.4; 24/622

(58) Field of Classification Search
CPC .... A44B 17/00; A44B 17/029; A44B 17/035; A44B 17/076; A44B 17/011; A44B 17/058
USPC ..... 24/90.5, 114.05, 114.4, 324, 594.11, 24/578.12, 586.11, 596.1, 622
See application file for complete search history.

(56) References Cited

U.S. PATENT DOCUMENTS 3,107,408 A * 10/1963 Huelster et al. ..... 24/621
3,159,890 A * 12/1964 Jensen ..... 24/618
3,538,557 A * 11/1970 Hirose ..... 24/679
3,540,086 A * 11/1970 Nysten ..... 24/687
3,583,039 A * 6/1971 Walker ..... 24/105
(Continued)

FOREIGN PATENT DOCUMENTS

JP 50-143702 11/1975
JP 59-89016 6/1984
(Continued)

OTHER PUBLICATIONS

International Search Report, PCT Application No. PCT/JPO91060635, mailed Sep. 8, 2009.

*Primary Examiner* — Robert J Sandy
*Assistant Examiner* — David Upchurch
(74) *Attorney, Agent, or Firm* — Kilpatrick Townsend & Stockton LLP

(57) ABSTRACT

A snap button wherein when a male snap is removed from a female snap, a rotation between the snaps is limited, but is permitted normally. A male-side grooved surface is provided on a male snap radially outward from a projection of the snap with a plurality of grooves formed so that peaks and troughs of the grooves are arranged continuously in the circumferential direction. A female-side grooved surface similar to the male-side grooved surface is provided on a female snap radially outward from a projection-receiving space of the snap. The female-side grooved surface is inclined relative to the male-side grooved surface. When the male snap is removed from the female snap, each axis of the male snap and the female snap, which are yet in a coupled state, inclines relative to each other, causing the male-side grooved surface and the female-side grooved surface to partially engage with each other.

5 Claims, 6 Drawing Sheets

(56) References Cited

U.S. PATENT DOCUMENTS

| | | | | | |
|---|---|---|---|---|---|
| 3,925,860 | A | * | 12/1975 | Furuya | 24/687 |
| 4,539,735 | A | * | 9/1985 | Kasai | 24/621 |
| 4,641,401 | A | * | 2/1987 | Hasegawa | 24/681 |
| 4,785,508 | A | * | 11/1988 | Takeda | 24/114.4 |
| 4,982,480 | A | * | 1/1991 | Kasai | 24/586.11 |
| 5,101,541 | A | * | 4/1992 | Watanabe | 24/674 |
| 6,353,978 | B1 | * | 3/2002 | Kawahara et al. | 24/114.4 |
| 6,757,945 | B2 | * | 7/2004 | Shibuya et al. | 24/662 |
| 7,013,539 | B2 | * | 3/2006 | Fildan et al. | 24/693 |
| 7,752,718 | B2 | * | 7/2010 | Fisher et al. | 24/114.4 |
| 2002/0029444 | A1 | * | 3/2002 | Lyle et al. | 24/621 |
| 2005/0251971 | A1 | * | 11/2005 | Fildan et al. | 24/114.6 |

FOREIGN PATENT DOCUMENTS

| | | | |
|---|---|---|---|
| JP | 4-74009 | | 6/1992 |
| JP | 2003-93114 | A | 4/2003 |
| JP | 2004-215683 | A | 8/2004 |

* cited by examiner

SNAP BUTTON

This application is a national stage application of PCT/JP2009/060635, which is incorporated herein by reference.

BACKGROUND OF THE INVENTION

The present invention relates to a snap button consisting of a pair of a male snap and a female snap.

A snap button consisting of a pair of a male snap and a female snap are commonly used for clothes, bags, etc. in their cloths or parts to be put together. The male snap and the female snap are fixed onto one of the cloths and the other, respectively, and the cloths are closed or opened by a user engaging or disengaging a cylindrical projection of the male snap to or from a projection-receiving space of the female snap. In such a snap button, when a user pulls the male snap-side cloth relative to the female cloth to remove the male snap from the female snap, sometimes the male snap would be hard to be removed because the projection of the male snap rotates on its own axis within the projection-receiving space of the female snap, and the male snap rotates relative to the female snap, relieving the pull force. In addition, a relative rotation between a male snap and a female snap can arise during usual motion such that a user wearing clothes with the male and female snaps fixed moves.

To cope with the above-matter that a male snap would be hard to be removed from a female snap (an off-action) due to a rotation of the male snap relative to the female snap, any measures could be taken to limit a relative rotation between the male and female snaps. In this case, a relative rotation between a male snap and a female snap, which can arise during usual motion such that a user wearing clothes with the male and female snaps fixed moves, could be limited. However, if a rotation between the snaps during usual motion of use is not permitted, there is a probability that cloth parts around the snaps or the snaps themselves will be damaged.

In view of the problems as mentioned above, an object of the present invention is to provide a snap button which can limit a rotation between a male snap and a female snap at the time of doing an off-action to remove the male snap from the female snap, and permit a rotation between the snaps during usual of use.

SUMMARY OF THE INVENTION

To solve the above problems, according to the present invention, there is provided a snap button comprising a pair of a male snap and a female snap, in which a projection projecting from a base of the male snap is to be coupled to and removed from a projection-receiving space of the female snap, the periphery of the projection being circular, and the periphery of the projection-receiving space being circular, wherein the base of the male snap includes an annular male-side engagement part in a radially outward area from the projection and on the projection-projecting side of the base, the male-side engagement part having thereon a plurality of bumps and/or a plurality of dips arranged in the circumferential direction, wherein the female snap includes an annular female-side engagement part in a radially outward area from the projection-receiving space and on the side facing the male snap at the time of the projection being coupled to the projection-receiving space, the female-side engagement part having thereon a plurality of dips and/or a plurality of bumps arranged in the circumferential direction, the male snap and the female snap at the time of the projection having been coupled to the projection-receiving space can move between a non-engagement state where each axis of the male snap and the female snap substantially matches with each other and the bumps and/or dips of the male-side engagement part do not engage with the dips and/or bumps of the female-side engagement part in the entire circumferential direction, and an engagement state where each axis of the male snap and the female snap inclines to each other, and the bumps and/or dips of the male-side engagement part engage with the dips and/or bumps of the female-side engagement part in a part in the circumferential direction.

In the invention, the male snap includes the male-side engagement part with a plurality of dips and/or bumps arranged in the circumferential direction, and the female snap includes the female-side engagement part with a plurality of bumps and dips arranged in the circumferential direction. The female-side engagement part can engage partially with the male-side engagement part when each axis of the male snap and the female snap inclines to each other. When the projection is in a state of being received in the projection-receiving space, the male snap and female snap are constructed as follows: That is, if each axis of the male snap and the female snap matches with each other or the snaps are concentric (or parallel) with each other, the dips and/or bumps of the male-side engagement part do not engage with the bumps and/or dips of the female-side engagement part in the entire circumferential direction (non-engagement state). And if each axis of the male snap and the female snap inclines to each other (for instance, greater than or equal to 10 degrees), the dips and/or bumps of the male-side engagement part engage with the bumps and/or dips of the female-side engagement part in a part in the circumferential direction (engagement state). The non-engagement state may include a minimum engagement state where the male-side engagement part and the female-side engagement part slightly engage with each other to an extent that a relative rotation between the snaps is allowed. The male snap and the female snap as coupled to each other can move between the non-engagement state and the engagement state. In the non-engagement state, since the male-side engagement part and the female-side engagement part do not engage with each other in the entire circumferential direction, a relative rotation between the snaps is permitted. On the other hand, in the engagement state, since the male-side engagement part and the female-side engagement part securely engage with each other in a part in the circumferential direction, a relative rotation between the snaps is limited by a resistance because of the engagement. When a cloth with the male snap is pulled in order to detach the projection of the male snap from the projection-receiving space of the female snap, the axis of the male snap inclines relative to the axis of the female snap in a coupled state before the male snap has separated from the female snap, and therefore a portion of the male-side engagement part engages with a portion of the female-side engagement part (engagement state), restricting a relative rotation between the snaps.

Further, for instance, in usual motion such that a user wearing clothes with the male and female snaps fixed moves, a force to incline the male snap to the female snap as exerted in an off-action would not be exerted, and therefore the axis of the male snap and the axis of the female snap which are in a coupled state stay substantially concentric. Accordingly, the male-side engagement part and the female-side engagement part scarcely engage with each other (non-engagement state), a relative rotation between the male and female snaps is allowed.

In an embodiment of the invention, the male-side engagement part is a male-side grooved surface on which a plurality of grooves are provided so that peaks and troughs of the grooves are arranged continuously in the entire circumferential direction, each of the grooves extending along in the radial direction, and the female-side engagement part is a female-side grooved surface on which a plurality of grooves are provided so that peaks and troughs of the grooves are arranged continuously in the entire circumferential direction at the same pitch as the peaks and troughs of the male-side grooved surface, each of the grooves extending along in the radial direction. In the embodiment, the female-side grooved surface inclines relative to the male-side grooved surface when each axis of the male snap and the female snap substantially matches with each other. In this case, in a non-engagement state, the peaks and troughs of the male-side grooved surface and the troughs and peaks of the female-side grooved surface scarcely engage with each other in the entire circumferential direction or the peaks and troughs of the male-side grooved surface and the troughs and peaks of the female-side grooved surface thinly engage with each other in only a part in the circumferential direction to an extent that a relative rotation between the snaps is allowed. And, in an engagement state, the peaks and troughs of the male-side grooved surface and the troughs and peaks of the female-side grooved surface securely engage with each other (that is, the peaks and troughs of the male-side grooved surface and the troughs and peaks of the female-side grooved surface deeply engage with each other relatively long in the groove longitudinal direction) in only a part in the circumferential direction.

In the invention, the male snap and the female snap can be made of, for example, metal material such as aluminum alloy, brass, etc. or resin material such as polyester, polybutylene terphthalate, polyacetal, etc.

In an embodiment of the invention, the male-side grooved surface is horizontal (or lies in a horizontal plane perpendicular to the axis), and the female-side grooved surface inclines, with respect to the horizontal, radially outward and downward. The angle of the female-side grooved surface inclining to the horizontal is, for instance, about 10 degrees to about 30 degrees.

In an embodiment of the invention, the base of the male snap includes a rise portion in a radially outward area from the projection, the rise portion rising in the projection-projecting side, and the male-side engagement part is formed on the top of the rise portion. The rising height of the rise portion can be about one-half the projecting height of the projection.

In an embodiment of the invention, the female snap includes a female snap body defining the projection-receiving space and an extension extending outward from the female snap body, and wherein the female-side engagement part is formed on the extension.

In the present invention, at the time of an off-action to detach the male snap from the female snap, the male snap inclines to the female snap, causing the male-side engagement part and the female-side engage part to engage with each other partially and securely and restricting a rotation between the snaps. Thereby, it is unlikely that the male snap is hard to be detached from the female snap. On the other hand, at the time of usual motion of a user wearing clothes with the male and female snaps attached, since the male-side engagement part and the female-side engagement part scarcely engage with each other, a relative rotation between the snaps is allowed. Thereby, a user would not be prevented from moving, and cloths and the snaps themselves would not be damaged.

DETAILED DESCRIPTION OF THE INVENTION

Figure 1:
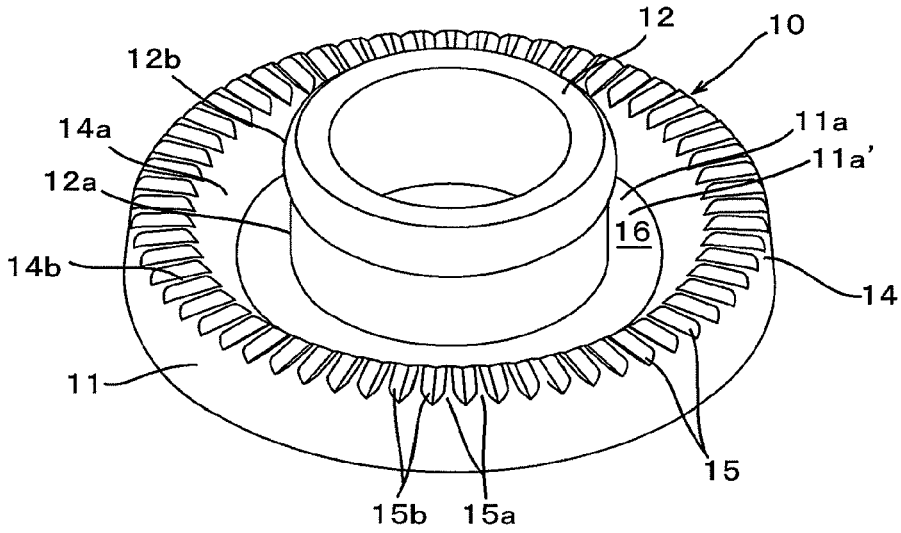
FIG. 1 is a perspective view of a male snap of a snap button according to an embodiment of the present invention.
Figure 2:
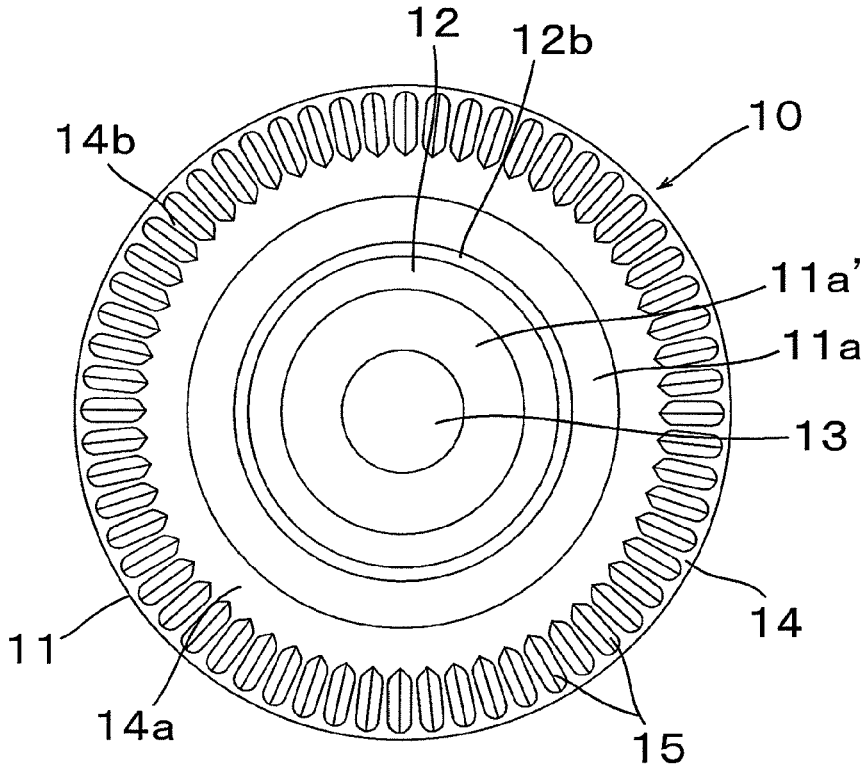
FIG. 2 is a plane view of the male snap shown in FIG. 1.
Figure 3:
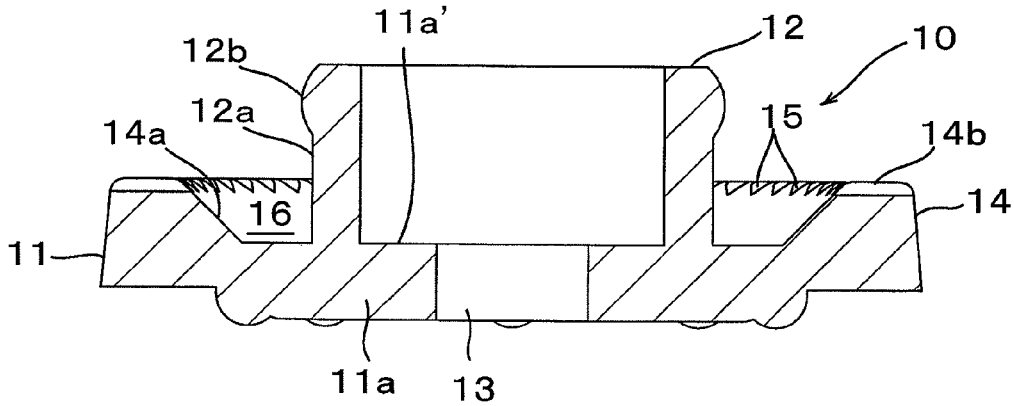
FIG. 3 is a vertical sectional view of the male snap shown in FIG. 1.
Figure 4:
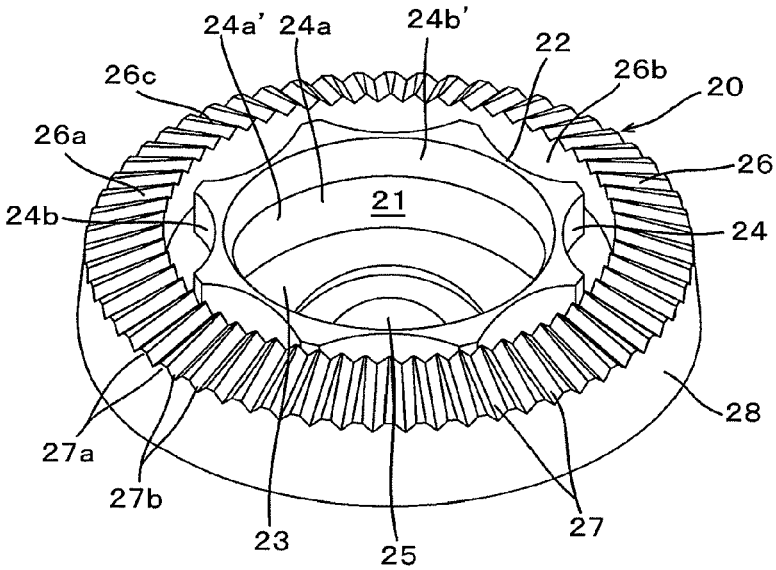
FIG. 4 is a perspective view of a female snap of the snap button according to the embodiment of the present invention.
Figure 5:
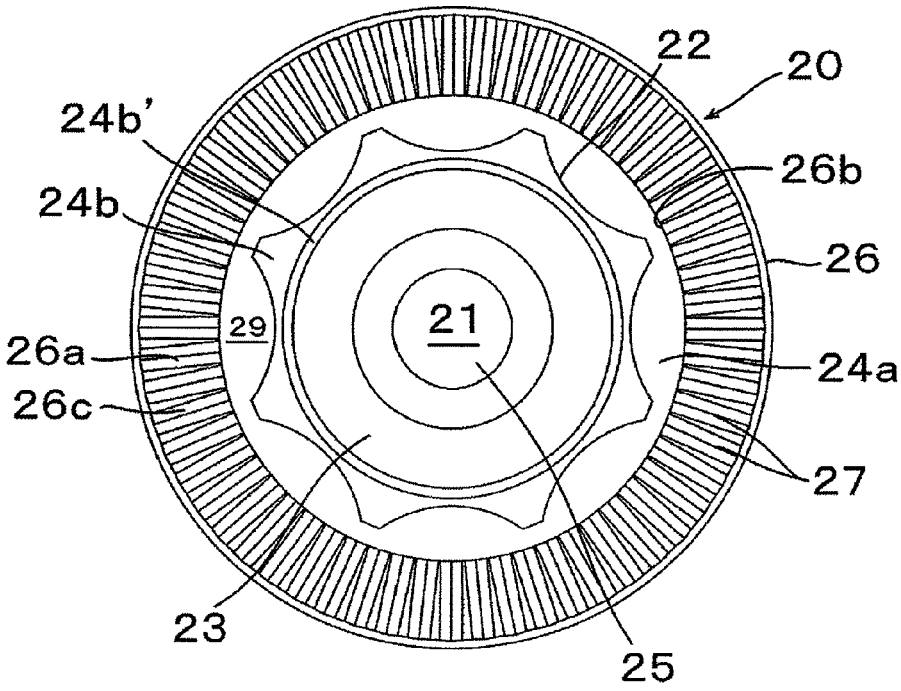
FIG. 5 is a plane view of the female snap shown in FIG. 4.
Figure 6:
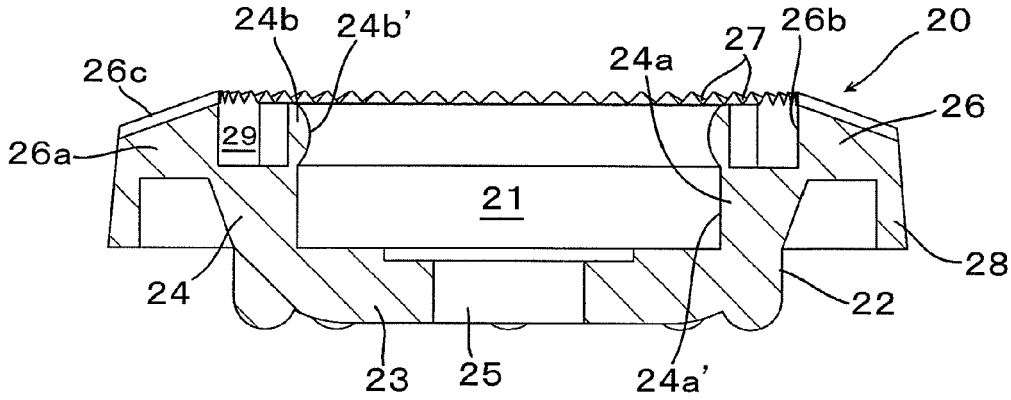
FIG. 6 is a vertical sectional view of the female snap shown in FIG. 4.

Hereinafter, an embodiment of a snap button according to the present invention will be described with referring to the drawings. FIGS. 1 to 3 are a perspective view, a plane view and a vertical sectional view of a male snap, respectively. FIGS. 4 to 6 are a perspective view, a plane view and a vertical sectional view of a female snap, respectively. The snap button consists of a pair of a male snap 10 and a female snap 20, both of which are molded products made of metal or plastic.

The male snap 10 comprises a generally disk-like base 11 having a thick, radially outer portion, and a cylindrical projection 12 projecting upward (this direction is based on FIG. 3) from the base 11 concentrically, the periphery of the projection 12 being circular. Hereinafter, the projecting direction of the projection 12 is referred to as upward. In a central portion of the base 11 radially inward from the projection 12, there is provided a circular opening 13, which receives a shank 32 of a male-snap fixing member 30 after the shank 32 has pierced a cloth 1 (see FIG. 7) when the male snap 10 is being fixed onto the cloth 1 as described later. The projection 12 has an annular male-side bulge 12*b* at an upper end portion on the outer surface 12*a* of the projection 12, the bulge 12*b* somewhat bulging radially outward relative to the outer surface 12*a* (except for its upper end portion). The base 11 includes a bottom plate portion 11*a* which defines the opening 13 by the radially inward end thereof and extends radially outward beyond the position of the projection 12 with a constant thickness, and a rise portion 14 rising upward from the bottom plate portion 11*a*, the thickness (height) of the rise portion 14 being gradually increasing radially outward from the bottom plate portion 11*a*. The rise portion 14 has a inclined surface 14*a* where the thickness of the rise portion 14 is gradually increasing radially outward from the bottom plate portion 11*a* as mentioned above, and an annular rise surface 14*b* as a male-side engagement part which extends horizontally and radially outward from the upper end of the inclined surface 14*a* to the radially outward end of the base 11 with a constant thickness. On the rise surface 14*b*, a plurality of grooves 15 are formed as described later. The height of the rise portion 14 or the rise surface 14*a* (the rise surface 14*a* assuming that the grooves are not formed) from the upper (front) surface 11*a*' of the bottom plate portion 11*a* is approximately half or less of the height of the projection 12 from the upper surface 11*a*'. As the base 11 includes the rise portion 14 at its radially outer end side, there lies an annular space 16 between the inclined surface 14*a* of the rise portion 14 and the outer surface 12*a* of the projection 12, the space 16 opening upward. The bottom of the space 16 is the upper surface 11*a*' of the bottom plate portion 11.

On the rise surface 14*b* of the rise portion 14, a plurality of grooves 15 are formed, each of which has a triangular cross section and extends along in the radial direction of the snap 10, the grooves 15 comprising peaks 15*a* as bumps (each of which is a triangular cross section bump between two adjacent grooves 15) and troughs 15*b* as dips (each of which substantially corresponds to each groove, and is a triangular cross section dip between two adjacent peaks 15). The peaks 15*a* and troughs 15*b* of the grooves 15 are arranged alternately and continuously in the entire circumferential direction of the snap 10. Hereinafter, the rise surface 14*b* with the multiple grooves 15 is referred to as a "male-side grooved surface."

The female snap 20 comprises a female snap body 22 defining a cylindrically concave projection-receiving space 21 to detachably receive the projection 12 of the male snap 10, and an annular extension 26 which extends radially outward from the body 22. On the extension 26, a female-side grooved surface 26*c* as a female-side engagement part is formed as described later. The inner surface (24*a*', 24*b*') of the female snap body 22 defining the projection-receiving space 21 is circular in horizontal cross section. The female body 22 includes a disk-like receiving space bottom 23 defining the bottom of the projection-receiving space 21, and a generally cylindrical receiving space side 24 extending upward (this direction is based on FIG. 6. Hereinafter, the direction is referred to as upward regarding the female snap 20) from the radially outer end of the receiving space bottom 23 and defining the peripheral surface of the space 21. In a central portion of the receiving space bottom 23, there is provided a circular opening 25, which receives a shank 42 of a female-snap fixing member 40 after the shank 42 has pierced a cloth 2 (see FIG. 7) when the female snap 20 is being fixed onto the cloth 1. The receiving space side 24 is sectioned into a lower proximal side 24*a* having a relatively thick thickness in the radial direction and an upper distal side 24*b* having a thickness which is thinner in the radial direction than that of the proximal side 24*a*. The inner side of the distal side 24*b* is formed as an annular female-side bulge 24*b*' somewhat bulging radially inward relative to the inner side 24*a*' of the proximal side 24*a*. The distal side 24*b* can be elastically deformed radially outward by the female-side bulge 24*b*' engaging with the male-side bulge 12*b* when the projection 12 of the male snap 10 is being coupled to or removed from the projection-receiving space 21. To promote such an elastic deformation, the distal side 24*b* is formed thinly in the radial direction. As shown in FIGS. 4 and 5, an outer side of the distal side 24*b* is formed in an approximately right octagonal shape with radially concave arc-notches cut between adjacent angles.

The extension 26 includes an extension base 26*a* connecting with an upper and radially outward end of the proximal side 24*a* and a skirt 28 extending downward from a lower and radially outward end of the extension base 26*a*. The extension base 26*a* has an inner face 26*b* which is vertical with respect to the horizontal, and a female-side grooved surface 26*c* as an inclined surface which is inclined radially outward and downward. The extension base 26*a* faces toward the outer side of the distal side 24*b* with an annular hollow 29 therebetween. The hollow 29 opens upward, the bottom of which is the upper surface of the proximal side 24*a*. On the female-side grooved surface 26*c*, a plurality of grooves a are formed, each of which has a triangular cross section and extends along in the radial direction of the snap 20 longer than each groove 15 of the male-side grooved surface 14*b*. Peaks 27*a* as bumps and troughs 27*b* as dips of the grooves 27 are arranged continuously in the entire circumferential direction of the snap 20. The number and the pitch of the peaks 27*a* and troughs 27*b* are the same as those of the male-side grooved surface 14*b*. The maximum height of the female-side grooved surface 26*c* (the inclined surface assuming that the grooves 27 are not formed) at the radially inward end of the surface 26*c* exceeds the top of the receiving space side 24 (or the distal side 24*b*) just by the depth of each groove 27 as seen from FIG. 6, and therefore the height or the position in the axial direction of the bottom of each groove 27 (or each trough 27*b*) at the radially inward end of the surface 26*c* is in conformity with the top of the receiving space side 24. The angle of the female-side grooved surface 26*c* inclining to the horizontal can be set between about 10 degrees to about 30 degrees.

Figure 7:
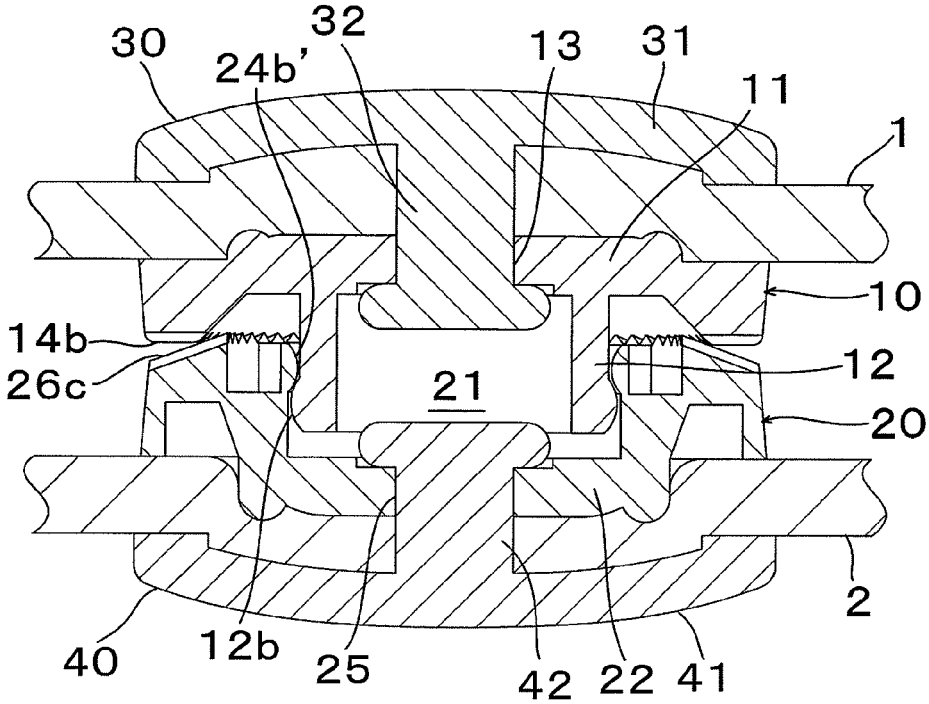
FIG. 7 is a vertical sectional view of the male snap and the female snap in a concentrically coupled state (non-engagement state)

FIG. 7 shows a concentrically coupled state (non-engagement state) where the projection 12 of the male snap 10 is received within the projection-receiving space 21 of the female snap 20 and the axis of the snap 10 is concentric with or matches with the axis of the snap 20. The male snap 10 and the female snap 20 have been fixed onto the cloths 1, 2 using a male-snap fixing member 30 and a female-snap fixing member 40, respectively, previously. Each of the fixing members 30, 40 includes a disk-like base 31, 41 and a shank 32, 42 projecting from the base 31, 41. The snaps 10 and 20 can be fixed onto the cloths 1, 2 by swaging the shanks 32, 42 after the shanks 32, 42 pierce the cloths 1, 2 and then pass through the openings 13, 25 of the snaps 10, 20, respectively. When the projection 12 is being coupled to or removed from the projection-receiving space 21, the male-side bulge 12*b* of the projection engages with the female-side bulge 24*b*' of the female snap 20, and then the male-side bulge 12*b* can be elastically deformed radially inward and/or the distal side 24*b* of the female snap 20 can be elastically deformed radially outward. The male-side bulge 12*b* and/or the distal side 24*b* will be restored immediately after the male-side bulge 12*b* has overcome the female-side bulge 24*b*'. The male-side bulge 12*b* and female-side bulge 24*b*' serve as a resistance for the projection 12 to be removed from the projection-receiving space 21. The depth advancement of the projection 12 in the projection-receiving space 21 is limited by the male-side grooved surface 14*b* bumping against the female-side grooved surface 26*c* before the top of the projection 12 reaches the bottom of the space 21 or the receiving space bottom 23.

In the coupled state of the snaps in FIG. 7, the radially inner end of the male-side grooved surface 14*b* is in contact with the inclined, female-side grooved surface 26*c* at a point (an upper point rather than the middle point) of the surface 14*b* entirely in the circumferential direction. In the state, the male-side grooved surface 14*b* and the female-side grooved surface 26*c* scarcely engage with each other or they engage with each other at a minimum point in the longitudinal direction of each of the grooves 15, 27. Therefore, in the state, a relative rotation between the male snap 10 and the female snap 20 can be permitted.

Figure 8:
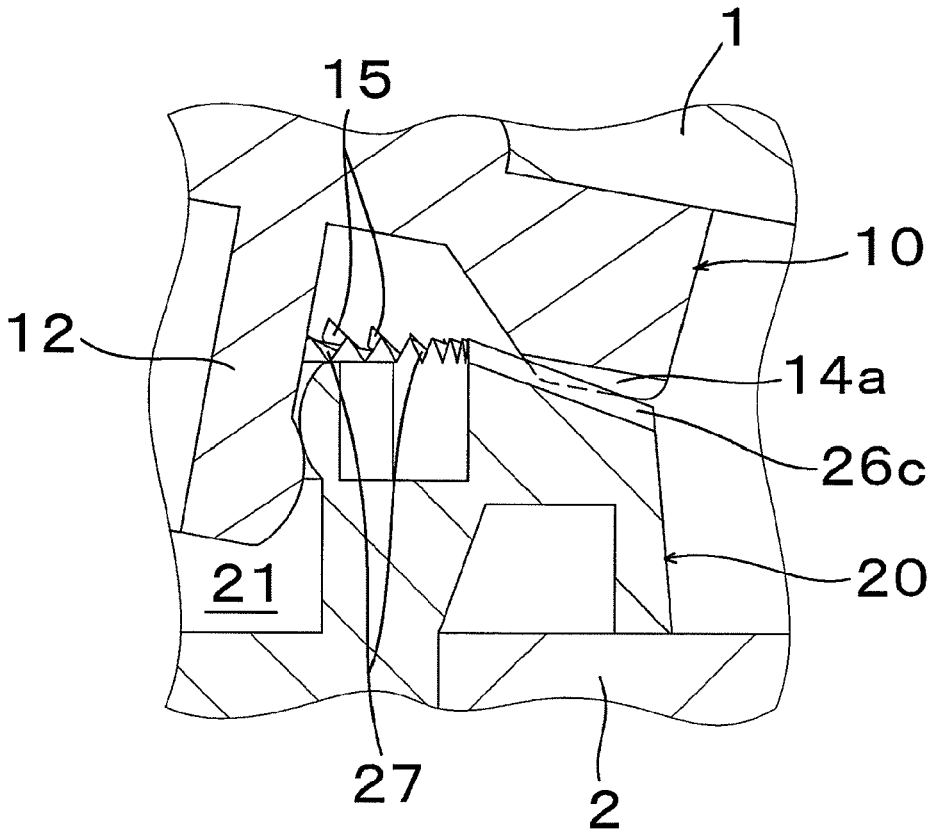
FIG. 8 is an enlarged, vertical sectional view of the male snap and the female snap in a coupled state with an inclination (engagement state)

FIG. 8 is an enlarged, vertical sectional view showing a coupled state with an inclination (engagement state) where the axis of the male snap 10 inclines relative to the axis of the female snap 20 from the FIG. 7 state. In the state, a part, in the circumferential direction, of the male-side grooved surface 14*b* is parallel to the corresponding part of the female-side grooved surface 26*c*, and these parts engage with each other deeply in the grooves 15, 27 and relatively long in the longitudinal direction of each of the grooves. In this state, a relative rotation between the male snap 10 and the female snap 20 can be limited. When the male snap 10 and the female snap 20 are coupled to each other, they can move between the non-engagement state and the engagement state. Though not shown in the drawings, the diametrically opposite parts, of the male-side grooved surface 14*b* and female-side grooved surface 26*c*, from the above-mentioned parts engaging deeply with each other are not in contact with each other with an increased space between the surfaces 14*b*, 26*c*.

Figure 9:
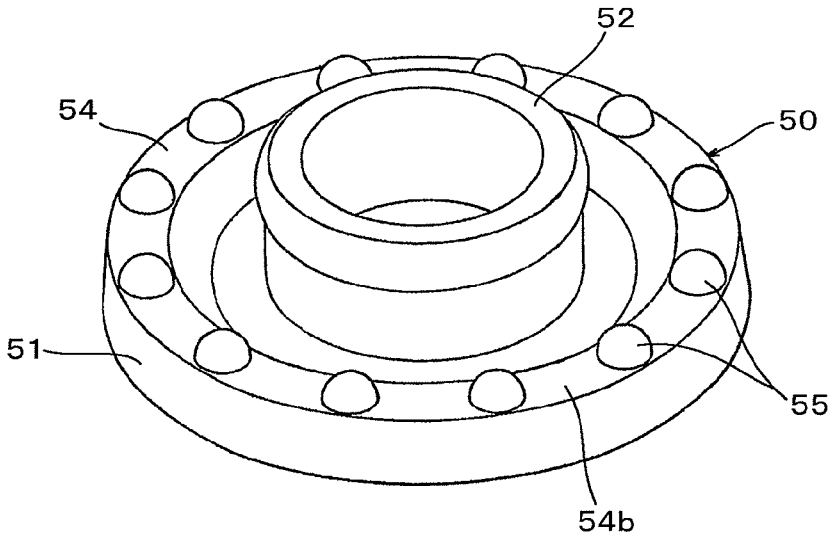
FIG. 9 is a perspective view of a male snap of a snap button according to another embodiment of the present invention.
Figure 10:
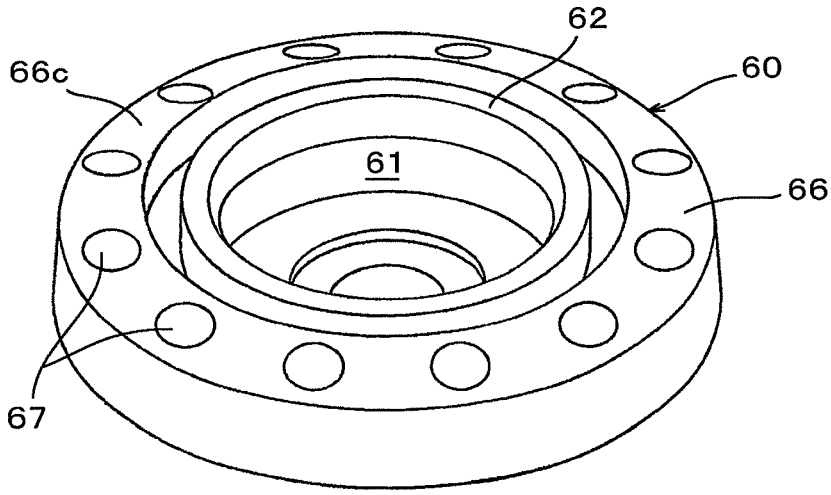
FIG. 10 is a perspective view of a female snap of the snap button according to the embodiment of the present invention.

FIGS. 9 and 10 are perspective views of another embodiment of a male snap 50 and female snap 60, respectively, according to the present invention. The snaps 50, 60 are different from the above-described snaps 10, 20 mainly in their male-side engagement part and female-side engagement part as follows: The male snap 50 comprises a base 51 and a projection 52 projecting from the base 51. The base 51 includes a rise portion 54 rising upward, the thickness of which is gradually increasing radially outward. The rise portion 54 has a horizontal, annular rise surface (a male-side engagement part) 54*b*. On the rise surface 54*b*, a plurality of hemispherical bumps 55 are formed at regular intervals in the circumferential direction. The female snap 60 comprises a female snap body 62 defining a projection-receiving space 61, and an annular extension 66 which extends radially outward from the body 66. The extension 66 includes an annular inclined surface (a female-side engagement part) 66*c* which is inclined, with respect to the horizontal, radially outward and downward. On the inclined surface 66*c*, a plurality of hemispherical dips 67 are formed in the circumferential direction in the same number and pitch as the bumps 55 of the male snap 50.

Figure 11:
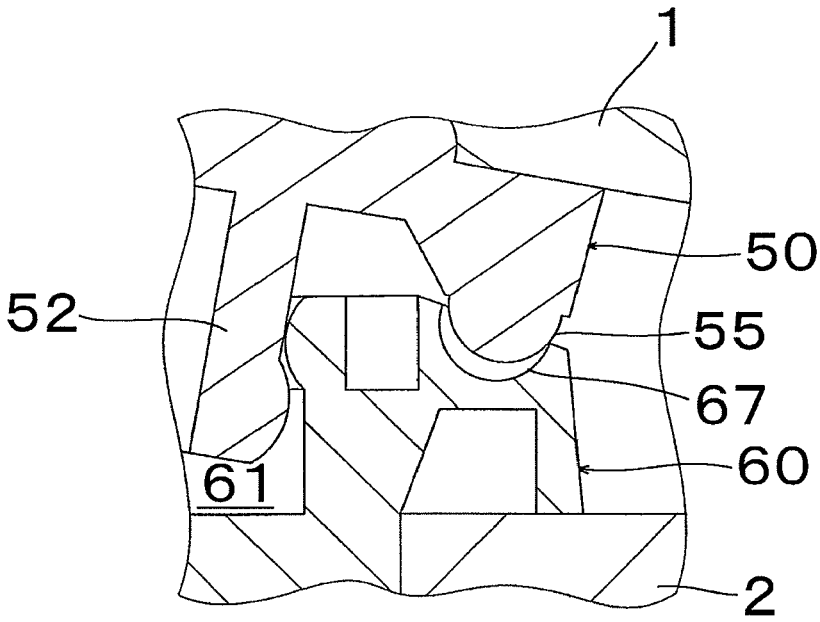
FIG. 11 is an enlarged, vertical sectional view of the male snap and the female snap in a coupled state with an inclination (engagement state).

In a concentrically coupled state (non-engagement state) (not shown) between the male snap 50 and the female snap 60, the bumps 55 of the male-side engagement part 54*b* and the dips 67 of the female-side engagement part 66*c* scarcely engage with each other, and therefore a relative rotation between the male snap 50 and the female snap 60 can be permitted. On the other hand, in a coupled state with an inclination (engagement state) as shown in FIG. 11, the bumps 55 of the male-side engagement part 54*b* and the dips 67 of the female-side engagement part 66*c* securely engage with each other in a part in the circumferential direction, and therefore a relative rotation between the male snap 50 and the female snap 60 can be limited.

In the above-described snap button, by pulling the cloth 1 to which the male snap 10, 50 has been fixed in order to remove the female snap 20, 60 from the male snap 10, 50, the male snap 10, 50 will incline relative to the female snap 20, 60 to be in the above coupled state with an inclination (engagement state), where the male snap 10, 50 does not rotate. Therefore, the pulling force is prevented from being relieved as in a prior-art snap button where a male snap rotates relative to a female snap. Thus, an off-action of the male snap 10, 50 can be done smoothly. Further, for instance, when a user wearing clothes with the male snap 10, 50 and the female snap 20, 60 fixed usually moves, the male snap 10, 50 would not be inclined relative to the female snap 20, 60 unlike an off-action. At this time, the male snap 10, 50 and the female snap 20, 60 are in the concentrically coupled state or a state close thereto, and therefore a relative rotation between the male snap 10, 50 and the female snap 20, 60 can be permitted. Thus, usual movement of a user would not be interrupted, and the male and female snaps 10, 50, 20, 60 themselves or parts of cloths 1, 2 around the snaps would not be damaged.

Description of Reference Numbers

10, 50 male snap
11, 51 base
12, 52 projection
14, 54 rise portion
14*b* male-side grooved surface (rise surface)
15 groove
15*a* peak
15*b* trough
20, 60 female snap
21, 61 projection-receiving space
22, 62 female snap body
26, 66 extension
26*c* female-side grooved surface
27 groove
27*a* peak
27*b* trough
54*b* male-side engagement part
55 bump
66*c* female-side engagement part
67 dip

The invention claimed is:

1. A snap button comprising a pair of a male snap and a female snap, in which a projection projecting from a base of the male snap is to be coupled to and removed from a projection-receiving space of the female snap, the periphery of the projection being circular, and the periphery of the projection-receiving space being circular, wherein the base of the male snap includes an annular male-side engagement part in a radially outward area from the projection and on a projection-projecting side of the base, the male-side engagement part having thereon a plurality of bumps and/or a plurality of dips arranged in a circumferential direction, wherein the female snap includes an annular female-side engagement part in a radially outward area from the projection-receiving space and on a side facing the male snap at the time of the projection being coupled to the projection-receiving space, the female-side engagement part having thereon a plurality of dips and/or a plurality of bumps arranged in the circumferential direction, and wherein when the projection of the male snap is coupled to the projection-receiving space of the female snap and an axis of the male snap and an axis of the female snap incline towards each other, a portion of the male-side engagement part, including the bumps and/or dips of the portion of the male-side engagement part engage with a portion of the female-side engagement part, including the dips and/or bumps of the portion of the female-side engagement part, along the circumferential direction.

2. A snap button comprising a pair of a male snap and a female snap, in which a projection projecting from a base of the male snap is to be coupled to and removed from a projection-receiving space of the female snap, the periphery of the projection being circular, and the periphery of the projection-receiving space being circular, wherein the base of the male snap includes an annular male-side engagement part in a radially outward area from the projection and on a projection-projecting side of the base, wherein the male-side engagement part is a male-side grooved surface on which a plurality of grooves are provided so that peaks and troughs of the grooves are arranged continuously in an entire circumferential direction, each of the grooves extending in the radial direction, wherein the female snap includes an annular female-side engagement part in a radially outward area from the projection-receiving space and on a side facing the male snap at the time of the projection being coupled to the projection-receiving space, wherein the female-side engagement part is a female-side grooved surface on which a plurality of grooves are provided so that peaks and troughs of the grooves are arranged continuously in the entire circumferential direction at the same pitch as the peaks and troughs of the male-side grooved surface, each of the grooves extending in the radial direction, wherein the female-side grooved surface inclines relative to the male-side grooved surface when an axis of the male snap and and an axis of the female snap substantially match, and wherein when the projection of the male snap is coupled to the projection-receiving space of the female snap and the axis of the male snap and the axis of the female snap incline towards each other, a portion of the male-side engagement part, including the peaks and troughs of the grooves of the portion of the male-side engagement part engage with a portion of the female-side engagement part, including the peaks and troughs of the grooves of the portion of the female-side engagement part, along the circumferential direction.

3. The snap button according to claim 2, wherein the male-side grooved surface is horizontal, and the female-side grooved surface inclines, with respect to the horizontal, radially outward and downward.

4. The snap button according to claim 1, wherein the base of the male snap includes a rise portion in a radially outward area from the projection, the rise portion rising in the projection-projecting side, and wherein the male-side engagement part is formed on the top of the rise portion.

5. The snap button according to claim 1, wherein the female snap includes a female snap body defining the projection-receiving space and an extension extending outward from the female snap body, and wherein the female-side engagement part is formed on the extension.

* * * * *

UNITED STATES PATENT AND TRADEMARK OFFICE

CERTIFICATE OF CORRECTION

PATENT NO. : 8,683,660 B2
APPLICATION NO. : 13/322977
DATED : April 1, 2014
INVENTOR(S) : Kenji Hasegawa et al.

It is certified that error appears in the above-identified patent and that said Letters Patent is hereby corrected as shown below:

In the Specification:

In column 2, line 15, Delete "and" and insert -- and/or --, therefor.

In column 3, line 30, Delete "terphthalate," and insert -- terephthalate, --, therefor.

In the Claims:

In column 9, line 9, In Claim 2, delete "and and" and insert -- and --, therefor.

Signed and Sealed this
Eighth Day of July, 2014

Michelle K. Lee

Michelle K. Lee
*Deputy Director of the United States Patent and Trademark Office*